US011925850B2

(12) United States Patent
Richard

(10) Patent No.: US 11,925,850 B2
(45) Date of Patent: Mar. 12, 2024

(54) PORTABLE MOUNTABLE SPORTS STICK RACK

(71) Applicant: Aaron Richard, Ottawa (CA)

(72) Inventor: Aaron Richard, Ottawa (CA)

( * ) Notice: Subject to any disclaimer, the term of this patent is extended or adjusted under 35 U.S.C. 154(b) by 0 days.

(21) Appl. No.: 17/776,439

(22) PCT Filed: Nov. 12, 2020

(86) PCT No.: PCT/CA2020/051531

§ 371 (c)(1),
(2) Date: May 12, 2022

(87) PCT Pub. No.: WO2021/092685

PCT Pub. Date: May 20, 2021

(65) Prior Publication Data

US 2022/0409979 A1 Dec. 29, 2022

Related U.S. Application Data

(60) Provisional application No. 62/934,192, filed on Nov. 12, 2019.

(51) Int. Cl.
*A63B 71/00* (2006.01)
*A47B 81/00* (2006.01)

(52) U.S. Cl.
CPC ..... *A63B 71/0036* (2013.01); *A47B 81/005* (2013.01); *A63B 2209/10* (2013.01)

(58) Field of Classification Search
CPC . A63B 71/0036; A63B 2209/10; A63B 71/45; A63B 2102/22; A63B 2102/24; A47B 81/005; A47G 25/12
See application file for complete search history.

(56) References Cited

U.S. PATENT DOCUMENTS 1,155,581 A * 10/1915 Kaiser ..... B65D 73/02 206/479
1,296,619 A * 3/1919 Bulat ..... A47D 13/025 224/907
1,678,353 A * 7/1928 Reach ..... A47F 7/0028 473/282

(Continued)

FOREIGN PATENT DOCUMENTS

CA 1306983 A 9/1992
CA 2230003 A1 8/1999

(Continued)

OTHER PUBLICATIONS

International Search Report and Written Opinion issued in International Application No. PCT/CA2020/051531, dated Feb. 12, 2021.

*Primary Examiner* — Stanton L Krycinski
(74) *Attorney, Agent, or Firm* — Morris, Manning & Martin, LLP; Daniel E. Sineway, Esq.

(57) ABSTRACT

There is provided a portable wall-mountable sports stick rack. The rack has a compliant support having a front side and an opposed rear side; a plurality of sports stick retaining channels along the front side adapted to receive a sports stick therethrough; and an adhesive layer associated with the rear side, the adhesive layer configured to removeably mount the sports stick rack to a wall surface.

20 Claims, 15 Drawing Sheets

(56) References Cited

U.S. PATENT DOCUMENTS 1,814,887 A * 7/1931 Bender ..... A63B 47/001 224/663
2,577,713 A * 12/1951 Nogle ..... A47B 81/005 211/104
3,610,490 A * 10/1971 Smith ..... A45F 3/04 224/585
4,308,982 A * 1/1982 Hall ..... A63C 11/025 294/147
4,654,991 A * 4/1987 Jones ..... A63H 33/40 40/124
4,790,460 A * 12/1988 Harper, Jr. ..... A45F 3/08 224/907
4,863,083 A * 9/1989 Chen ..... A63C 11/025 224/663
4,995,537 A * 2/1991 Thedieck ..... B60R 7/14 224/547
5,005,710 A * 4/1991 Hofer ..... B25H 3/04 D6/567
5,027,960 A * 7/1991 Rainville ..... B63B 32/83 211/85.7
5,174,447 A * 12/1992 Fleming ..... B25H 3/00 220/500
5,242,063 A * 9/1993 Ericksen ..... A47K 3/281 248/205.2
5,337,907 A * 8/1994 McKenzie ..... A45F 3/00 206/427
5,544,797 A * 8/1996 Silva ..... B60R 7/08 224/311
5,842,584 A * 12/1998 Baird ..... B25F 5/029 224/901.4
6,065,659 A * 5/2000 Faz ..... A45C 11/26 224/684
6,158,593 A * 12/2000 Olsen ..... A63B 47/00 206/315.9
6,176,403 B1 * 1/2001 Svare ..... A45F 5/02 224/919
6,394,287 B2 * 5/2002 Cabrera ..... A63B 57/60 211/89.01
6,405,909 B1 * 6/2002 Burnett ..... F41C 33/06 D6/552
6,419,097 B1 7/2002 Anderson
6,547,085 B2 * 4/2003 Belisle ..... A63B 71/0045 211/85.7
6,736,302 B1 * 5/2004 Brownlee ..... A63B 71/0036 224/907
6,749,074 B1 * 6/2004 Hileman ..... A47F 7/0028 211/85.7
6,910,578 B2 * 6/2005 Stern ..... B25H 3/003 211/69.1
7,237,685 B2 * 7/2007 Keegan ..... A47F 7/0028 211/60.1
D579,252 S 10/2008 Savoie
7,441,669 B1 * 10/2008 Dalbey ..... A63B 60/60 211/85.7
7,837,043 B2 * 11/2010 Reason-Kerkhoff ..... A63B 71/0045 211/13.1
7,954,639 B2 * 6/2011 Carney ..... A63B 71/0036 211/60.1
D699,030 S * 2/2014 Etzler ..... D3/206
8,875,883 B2 * 11/2014 Kinskey ..... B65D 33/00 206/373
9,115,948 B2 * 8/2015 Murphey ..... F16M 13/02
9,149,134 B2 10/2015 Diwan
9,282,817 B2 * 3/2016 Yates ..... A47B 81/005
9,302,141 B2 * 4/2016 Haley ..... A63B 21/065
D760,503 S * 7/2016 Arguelles ..... D6/315
9,597,789 B2 * 3/2017 Yoosefi ..... B65D 75/52
10,207,401 B1 * 2/2019 Pedrin ..... B25H 3/003
10,688,371 B1 * 6/2020 Searcy ..... A63B 71/0036
11,013,325 B2 * 5/2021 Meyer ..... A47F 5/0006
11,026,417 B2 * 6/2021 Power, II ..... A01M 31/02
11,330,881 B2 * 5/2022 Eaton ..... A45C 13/10
2003/0062328 A1 4/2003 Millard
2006/0011566 A1 1/2006 Guy
2007/0102380 A1 * 5/2007 Shaw ..... A63B 71/0036 211/85.7
2007/0193966 A1 * 8/2007 Dettorre ..... A63B 71/0036 211/70.5
2008/0087785 A1 * 4/2008 Roche ..... A47B 81/005 248/309.4
2009/0039225 A1 2/2009 Taylor
2009/0184225 A1 * 7/2009 Gleick ..... A63B 71/0036 248/314
2009/0264226 A1 * 10/2009 Mauro ..... A63B 63/083 473/488
2010/0108626 A1 * 5/2010 Sorensen ..... B60R 7/08 211/70.8
2011/0147542 A1 6/2011 Hoek
2012/0234505 A1 * 9/2012 Hartwig ..... E06B 7/28 248/220.22
2014/0306076 A1 10/2014 Friesch
2017/0210003 A1 * 7/2017 Kopans ..... B25H 3/04
2018/0169502 A1 6/2018 Reed, Jr.

FOREIGN PATENT DOCUMENTS

CA 2334053 A1 8/2002
CA 2527688 A1 5/2007
CA 2682577 A1 4/2010
WO 2001/020877 A1 3/2001
WO 2017/218703 A1 12/2017

* cited by examiner

PORTABLE MOUNTABLE SPORTS STICK RACK

REFERENCE TO RELATED APPLICATIONS

This application is a national phase entry of, and claims the benefit of and priority to, International Patent App. No. PCT/CA2020/051531, filed Nov. 12, 2020, and entitled "PORTABLE MOUNTABLE SPORTS STICK RACK," which claims the benefit of, and priority to, United States Provisional App. No. 62/934,192 filed Nov. 12, 2019, entitled "PORTABLE MOUNTABLE SPORTS STICK RACK", the contents of which are incorporated herein by reference in their entirety.

TECHNICAL FIELD

The present invention relates to a mountable portable sports stick rack for holding sports sticks.

BACKGROUND

Players and coaches often travel from one sports venue or one training facility to another. Sports sticks which include, but are not limited to, ice hockey sticks, ringette sticks, field hockey sticks, lacrosse sticks, curling brooms, baseball bats, cricket bats, novelty mini hockey sticks, and other similar sports articles, generally have an elongate shaft or handle and are generally not free-standing and will topple if they are not supported. Additionally, at any given sports venue or training facility, there can be many numbers of sports sticks belonging to the same user or to different users and this makes storage difficult and/or cumbersome. Currently available sports stick racks for supporting and organizing sports sticks are not portable and are not suitable for carrying by players and coaches during travel.

Accordingly, there is a need to provide a sports stick rack that can be easily carried by a user when moving from one location to another location and that is removeably mountable to a surface and then support and organize the sports sticks.

SUMMARY OF THE INVENTION

It is an embodiment of the present invention to provide a portable mountable sports stick rack for holding sports sticks.

In one embodiment, there is provided a portable wall-mountable sports stick rack comprising: a continuously compliant support having a front side and an opposed rear side; a plurality of sports stick retaining channels along the front side adapted to receive a sports stick therethrough; and an adhesive layer associated with the rear side, the adhesive layer configured to removeably mount the sports stick rack to a wall surface, wherein said continuously compliant support is configured to move between a furled compact position for carrying by a user when the rack is unmounted from the wall surface to an unfurled position for mounting the rack to the wall surface.

In one aspect, the rack further comprises a cover configured to reversibly move between a covered position wherein the adhesive layer is covered by the cover to an exposed position wherein the adhesive layer is exposed for attaching the sports stick rack to the wall surface. In one aspect, the cover comprises a fixed end secured to the support and a free end. In one aspect, the rack further comprises a cover fastener secured to the support for releasably securing the free end of the cover when the cover is moved to the exposed position. In one aspect, the cover is a film or tape.

In one aspect, the adhesive layer is reversibly associated with the rear side.

In one aspect, the rack further comprises first cooperatively engaging fasteners secured to the rear side and an adhesive portion comprising, on one side, second cooperatively engaging fasteners adapted to reversibly couple to the first cooperatively engaging fasteners, and on another side, the adhesive layer. In one aspect, the first and second cooperatively engaging fasteners are hook and loop fasteners, and preferably a Velcro-type material.

In one aspect, the adhesive layer substantially covers the rear side of the support.

In one aspect, the compliant support is configured to be foldable into a compact position suitable for carrying by a user when the rack is unmounted from the wall surface. In one aspect, the compliant support comprises nylon.

In one aspect, the rack further comprises closures for releasably maintaining the rack in the compact position. In one aspect, the closures are cooperatively engaging tabs or male and female buckles at opposed ends of the support.

In one aspect, the plurality of sports stick retaining channels comprise a pair of arms projecting from the support. In one aspect, the plurality of sports stick retaining channels comprise a base secured to the support, the pair of arms attached to and projecting away from the base. In one aspect, the pair of arms being able to flex with respect to the support to receive the sport stick interferingly therebetween. In one aspect, each one of the plurality of sports stick retaining channels is independently moveable in respect to one or more adjacent sports stick retaining channels.

In one aspect, the rack further comprises a channel cover and means to reversibly secure the channel cover to the channel, wherein when the channel is secured to the channel cover, the channel cover resists withdrawal of the sports stick out of the channel.

In one aspect, the rack further comprises a lever adapted for the user to hold and apply a pulling force sufficient overcome the force of adhesion of the adhesive layer so as to peel the mounted rack away from the wall surface. In one aspect, the lever is at an end of the compliant support. In one aspect, the lever comprises an L-shaped body adapted to allow the user to hold the L-shaped body and apply the pulling force.

In one aspect, the rack further comprises one or more mounting clips secured to the support and adapted for reversibly clipping items to the rack.

In one aspect, the rack further comprises one or more accessory mounts secured to the support and adapted for attaching one or more accessories to the rack. In one aspect, the one or more accessories comprises a sport stick harness secured to the compliant support, wherein the harness is adapted to encircle one or more sports sticks therein when the one or more sports sticks are emplaced on the sport stick rack.

In one aspect, the harness is adapted to be caused to tightly secure the one or more sports sticks encircled therein when the one or more sports sticks are displaced from sport stick rack. In one aspect, the harness is removably securable to the accessory mount secured to the compliant support. In one aspect, the harness is removably securable between the ends of the compliant support.

In one aspect, the harness comprises a first strap having a first end couplable to a second end to form an adjustable closed loop to tighten around a portion of the one or more sports sticks. In one aspect, the harness comprises a second strap having a first end couplable to a second end to form an adjustable closed loop around a lower portion of the one or more sports sticks. In one aspect, the first end and second end comprise mutually cooperating male and female locking buckles to reversibly lock the first end to the second end. In one aspect, the male and female locking buckles are adapted so that the first strap and/or the second strap can be tightened a right handed pulling action or a left handed pulling action.

In one aspect, the harness comprises an elongate connecting strap connecting the first strap to the second strap. In one aspect, the elongate connecting strap is reversibly securable to the first strap and/or the second strap.

In one embodiment, there is provided a kit for a portable wall-mountable sports stick rack, the kit comprising: a continuously compliant support having a front side and an opposed rear side; a plurality of sports stick retaining members secured to the front side; and an adhesive portion securable to the rear side, the adhesive portion comprising an adhesive layer and configured to expose the adhesive surface for removeably securing the sports stick rack to a wall surface, wherein said continuously compliant support is configured to move between a furled compact position for carrying by a user when the rack is unmounted from the wall surface to an unfurled position for mounting the rack to the wall surface.

In one aspect, the adhesive portion is reversibly associated with the compliant support.

In one aspect, the compliant support comprises first cooperatively engaging fasteners secured to the rear side and the adhesive portion comprising, on one side, second cooperatively engaging fasteners adapted to reversibly couple to the first cooperatively engaging fasteners, and on another side, the adhesive layer.

DETAILED DESCRIPTION

Figure 1:
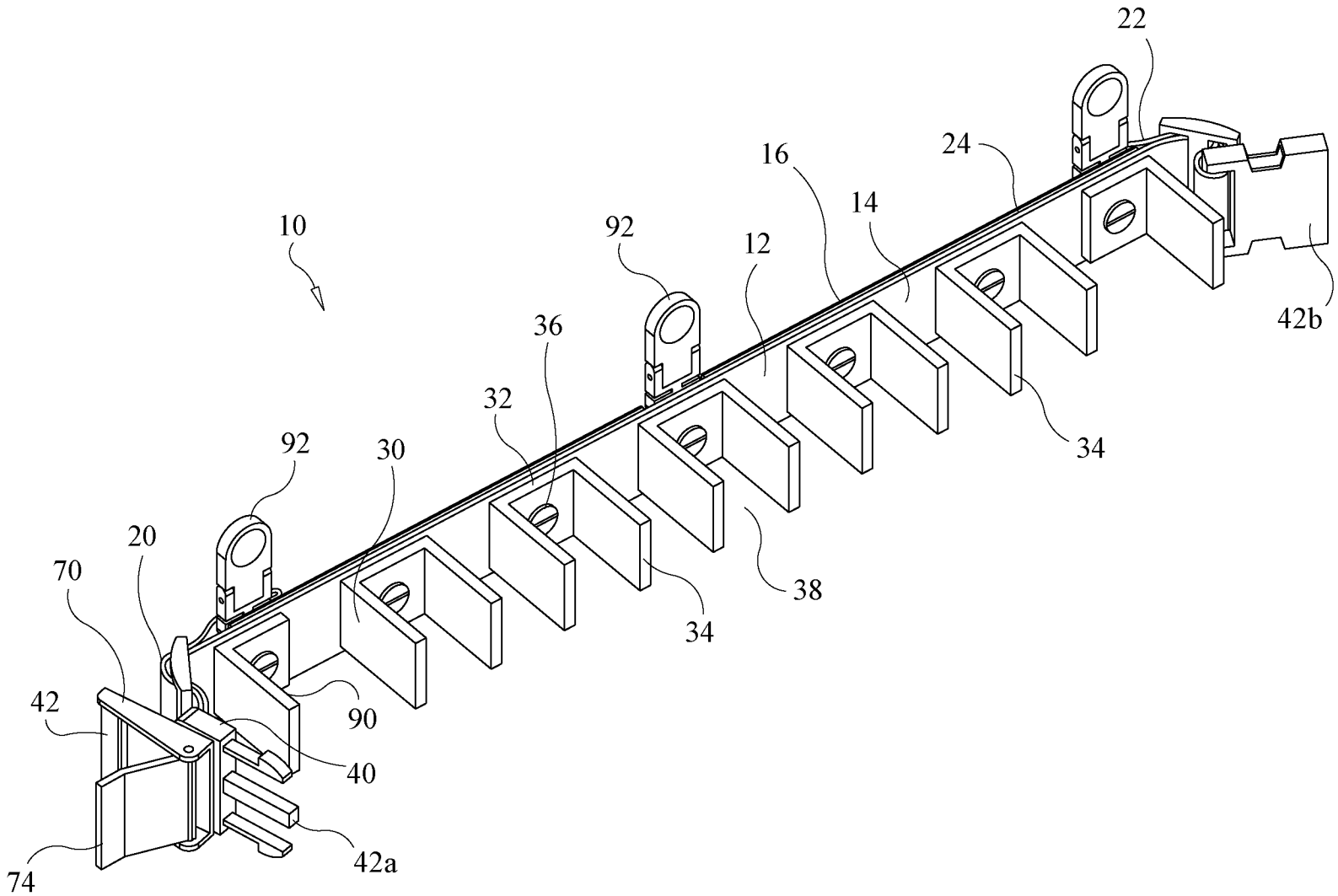
FIG. 1 is a front perspective view of a portable mountable sports stick rack in accordance with an embodiment of the invention.

Reference will be made below in detail to exemplary embodiments of the invention, examples of which are illustrated in the accompanying drawings. Wherever possible, the same reference numerals used throughout the drawings refer to the same or like parts.

Figure 12:
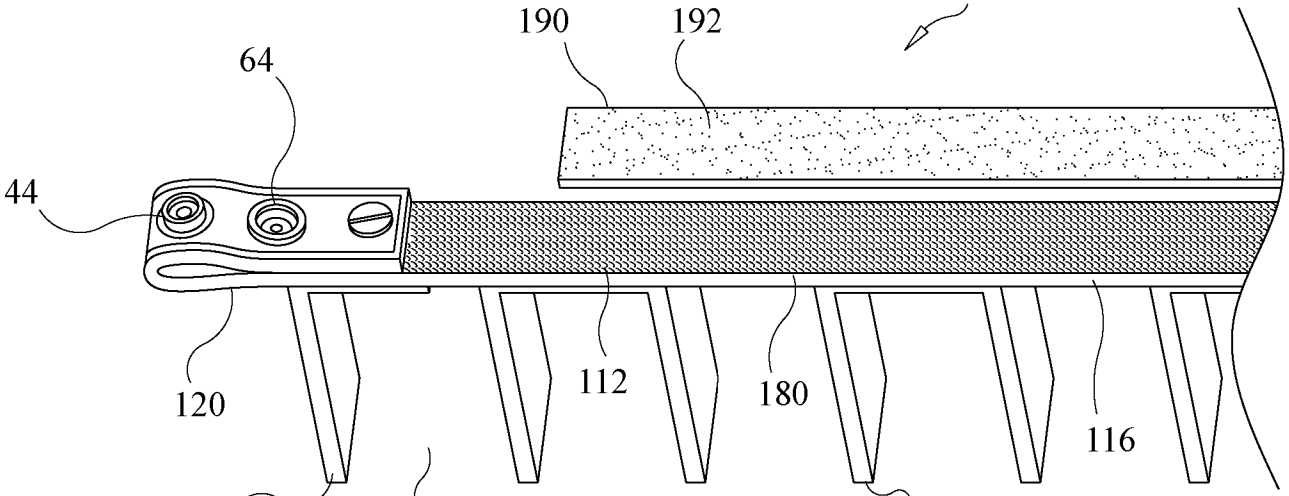
FIG. 12 is an enlarged view of the portable mountable sports stick rack of FIG. 8 showing another end.
Figure 14:
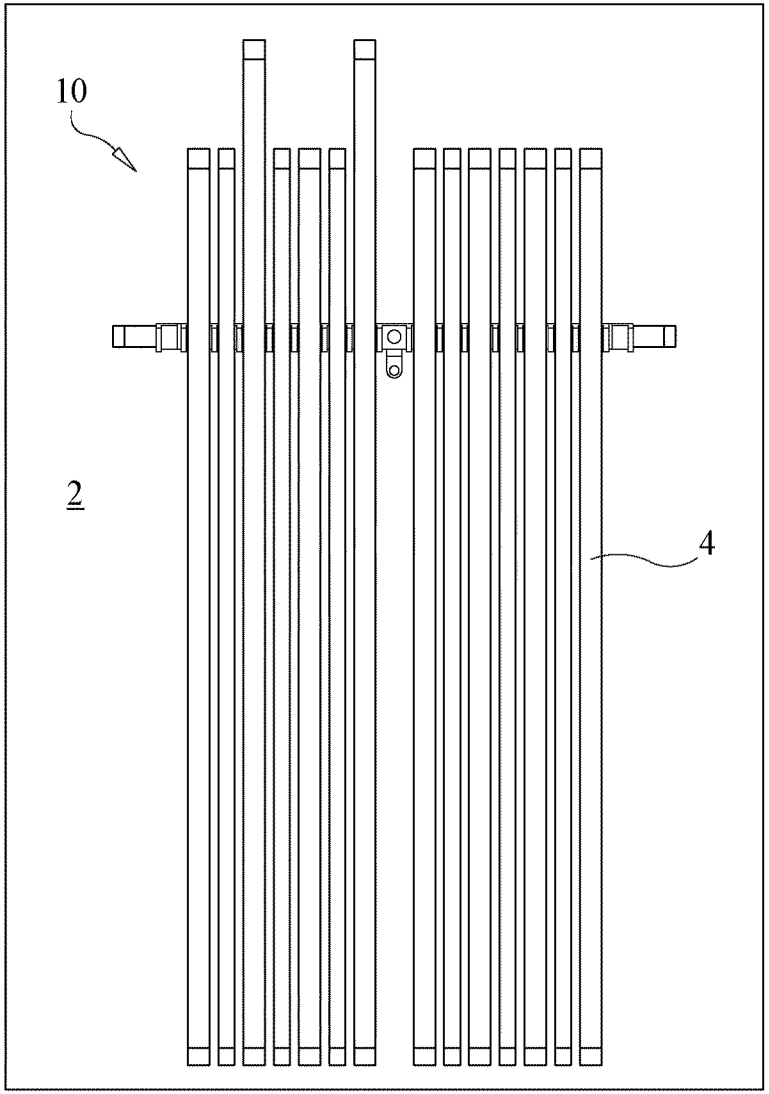
FIG. 14 shows the portable mountable sports stick rack of FIG. 1 mounted on a wall surface and securing ringette sticks in accordance with an embodiment of the invention.
Figure 13:
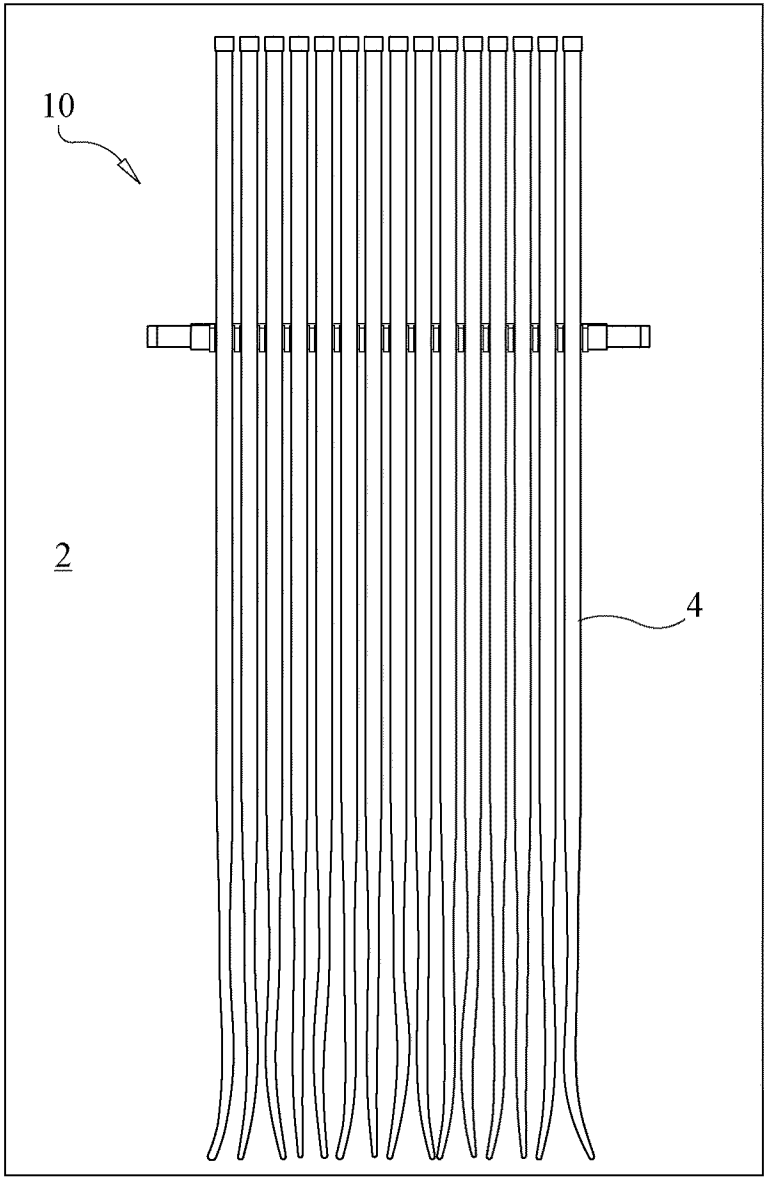
FIG. 13 shows the portable mountable sports stick rack of FIG. 1 mounted on a wall surface and securing hockey sticks in accordance with an embodiment of the invention.

Referring now to the collective drawings (i.e., FIGS. 1-22), and in particular to FIGS. 1 to 4 which show a first embodiment 10 of the portable mountable sports stick rack which generally comprises a support 12 having: front side 14 and an opposed rear side 16; first end 20 and second end 22, wherein the first end and the second end define length 24 therebetween; wherein the rear side 16 is adapted for placement upon a wall surface 2 (as shown in FIGS. 13 and 14);

wherein the front side 14 comprises at least one sports stick retaining channel 30 for receiving a sports stick 4 (as shown for example, in FIG. 13 which shows hockey sticks and FIG. 14 which shows ringette sticks) therethrough; and wherein the channel 30 is adapted to releasably secure the sports stick 4 in an upright vertical position when the portable mountable sports stick rack 10 is secured to the wall surface 2.

The term wall surface means, for example, any structure suitable for mounting the portable sports stick rack. Typical structures include but are not limited to a wall of a building, a post, a fence/gate, a tree, and the like. Other suitable structures for mounting the portable mountable sports stick rack 10 include, but are not limited to, counters, tables, and bookshelves which can straight or angled mounting surfaces. The mounting surface does not need to be planar and can have a curvature such as seen in a building pillar or a rounded table corner of a table. As well, the surface does not need to have any particular finish and can be smooth, rough, or have an irregular or regular repeating surface.

The support 12 is compliant which means, for example, the support 12 is any one or more of flexible, resilient, twistable, bendable and/or foldable. In some aspects, the support 12 will assume a desired shape under manipulation by the hand of the user and will retain this desired shape until the user further manipulates it into another shape. The support 12 can be made from any suitable materials, such as but not limited to, nylon and nylon formed into a strap or silicone and silicone-type material, and in aspects, the strap is malleable, flexible, and/or can be twisted. In aspects, the support can have any width (defined as the distance between the relative top and the bottom of the support 12 when the portable mountable sports stick rack is secured to the wall surface 2) desired. In some aspects, the width can be about 0.75", 1", 1.5", or 2".

Figure 2:
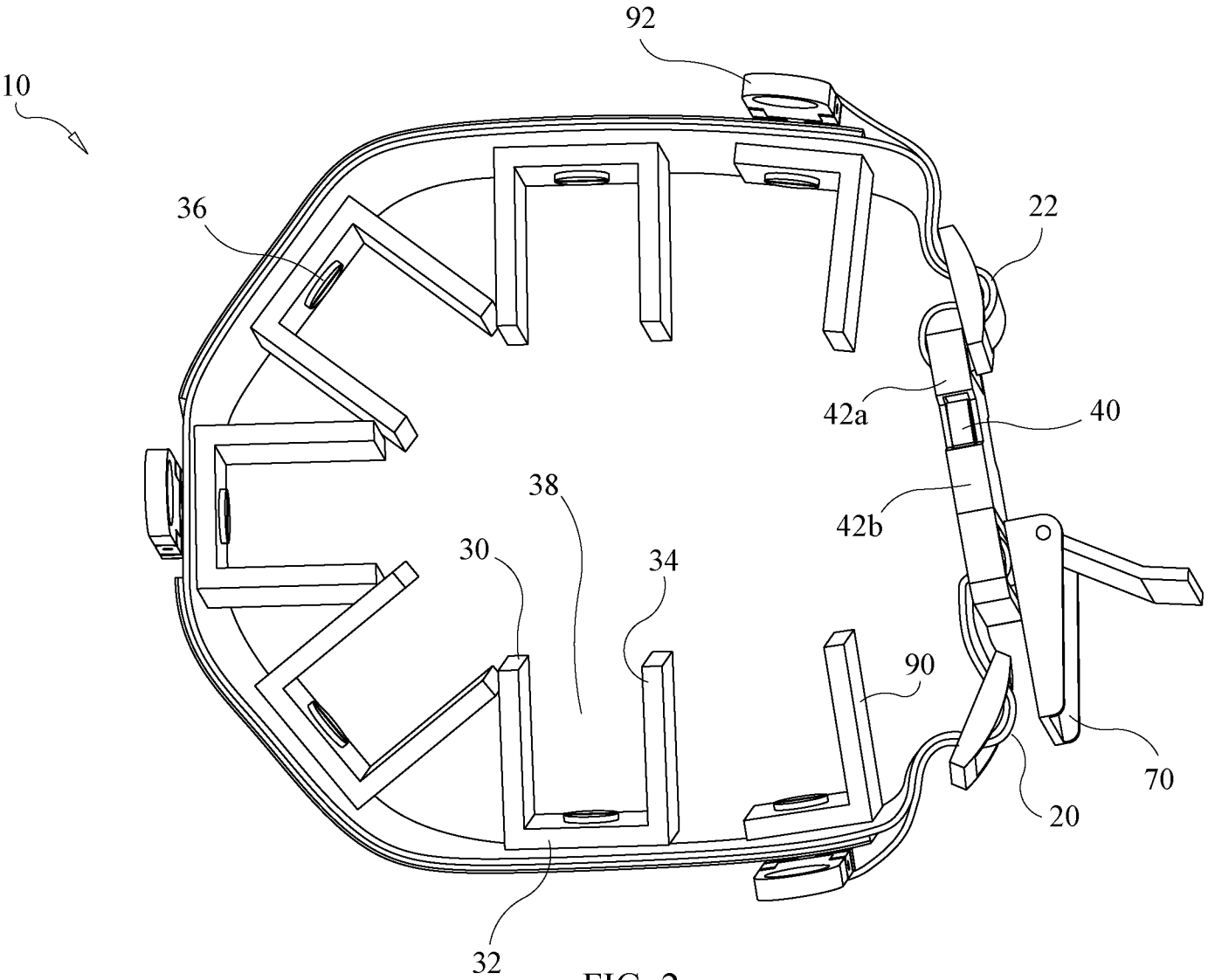
FIG. 2 is a bottom view of the portable mountable sports stick rack of FIG. 1 showing sufficient compliance such that the ends are adapted to connect to each other in a compact position.
Figure 3:
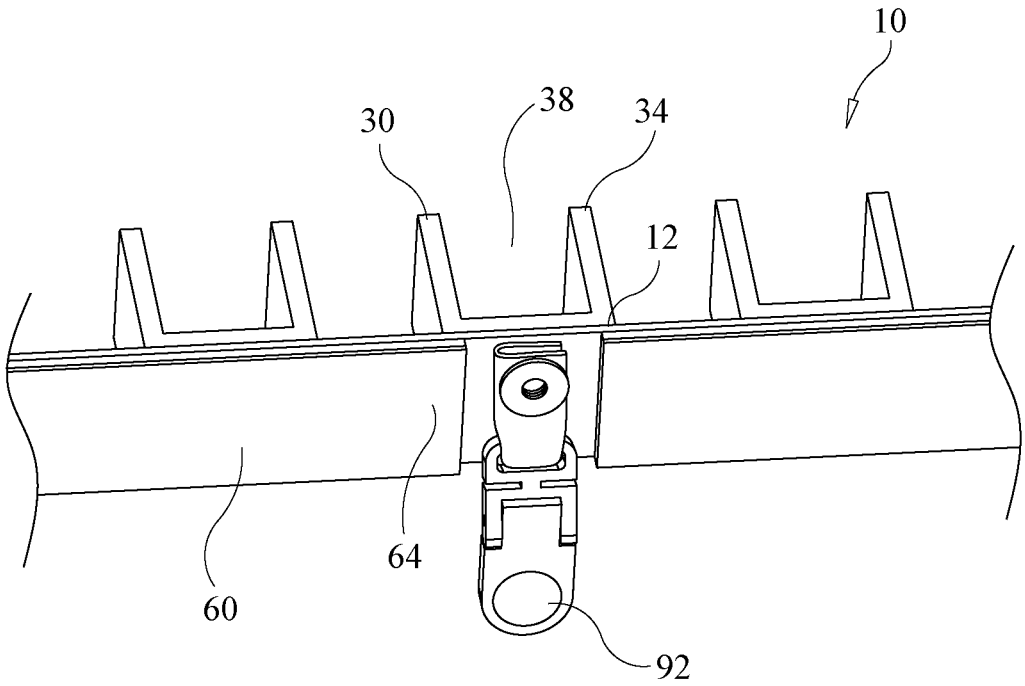
FIG. 3 is a rear perspective of the portable mountable sports stick rack of FIG. 1 showing a cover for configured to reversibly cover an adhesive layer for removeably adhering the rack to a wall surface.

As shown in FIG. 2, rack 10, may optionally be sufficiently compliant such that both first and second ends 20 and 22, respectively, are capable of being brought together via manipulation by the user into a compact position suitable for carrying by the user. The rack 10 can be maintained in this compact position until which time the user desires to unfurl the rack 10 and expose the rear side 16 to mount the rack 10 to the wall surface 2.

As shown in FIGS. 1 and 2, support 12 further comprises closures 40 adapted for releasably maintaining the rack 10 in the compact position suitable for carrying by the user. As shown in FIGS. 1 and 2, the closures 40 can comprise male and female buckles 42*a* and 42*b* at opposed ends 20, 22 of the support 12 that connect to each other to lock the rack 10 in the compact position.

Referring now to FIGS. 3, 4 and 13 to 23, sports stick rack 10 includes rear side 16 adapted for receiving an adhesive layer 50, such as for example, double-sided sticky tape, which is adapted to removeably adhere the rack 10 to the wall surface 2. Adhesive layer 50 comprises an adhesive 52 that has a sufficient strength to mount the rack 10 to the wall surface and support or at least partially support the weight of one or more sport sticks when in use, but the adhesive 52 is not so strong so that the rack 10 would remain permanently mounted to the wall surface. In aspects, the adhesive layer 50 is configured to allow the rack 10 to be attached and detached from the wall surface 2 repeatedly.

After repeated attachment and detachment of the sport stick rack 10 to the wall surface, it would not be unusual to observe that the adhesive 52 would lose strength. In some embodiments, the adhesive layer 50 can be adapted so that the used adhesive 52 can be renewed after repeated attachment and detachment of the sport stick rack 10. In one aspect, the used adhesive 52 can be restored by application of a spray adhesive, such as but not limited to, 3M super 77™ multipurpose spray adhesive. In another aspect, the adhesive layer 50 can comprise multiple layers wherein at least one layer that comprises the used adhesive 52 can be separated from the remaining other layer(s) and an entirely new layer comprising new adhesive 52 can then be joined to the other layer(s).

With reference to FIGS. 3, 4, and 13 to 23, rack 10 further comprises a cover 60 that is configured to reversibly move between a covered position wherein the adhesive layer 50 is protected by the cover 60 to an exposed position wherein the adhesive layer 50 is exposed for mounting the rack 10 to the wall surface. The cover 60 comprises a fixed end 62 that is secured to the support 12 and a free end 64 that is adapted to move away from the support 12. In some embodiments, the cover 60 comprises a film or tape that is pliable and can be easily peeled away from the support 12.

Figure 4:
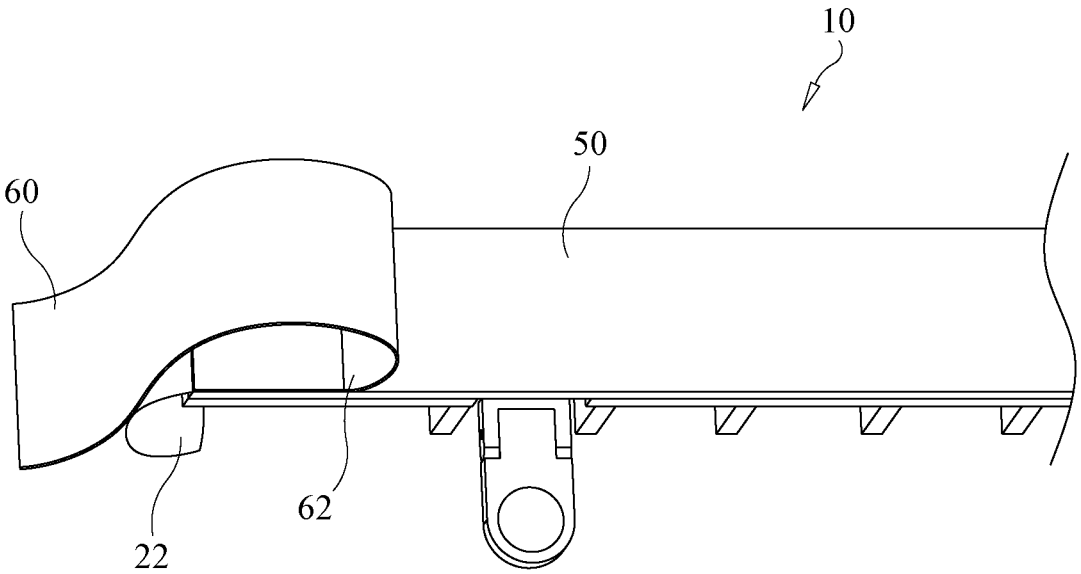
FIG. 4 is a rear perspective of the portable mountable sports stick rack of FIG. 1 showing the cover displaced and exposing the adhesive layer.

As shown in FIGS. 1, 2, 4, 5 to 7, 15 to 17, and 19 to 23 rack 10 further comprises a cover fastener 70 secured to the support 12. The cover fastener 70 is adapted to releasably secure the free end 64 when the cover 60 is moved into the exposed position as best shown in FIG. 4. In one aspect as shown in FIGS. 1 and 2, the cover fastener 70 is located at one or more of the end 20 and 22 and defines a recess 72 dimensioned for receiving the free end of the cover 60 and comprises a flap 74 that is actuable to cause the flap 74 to clamp over at least a portion of the free end within the recess 72.

Figure 5:
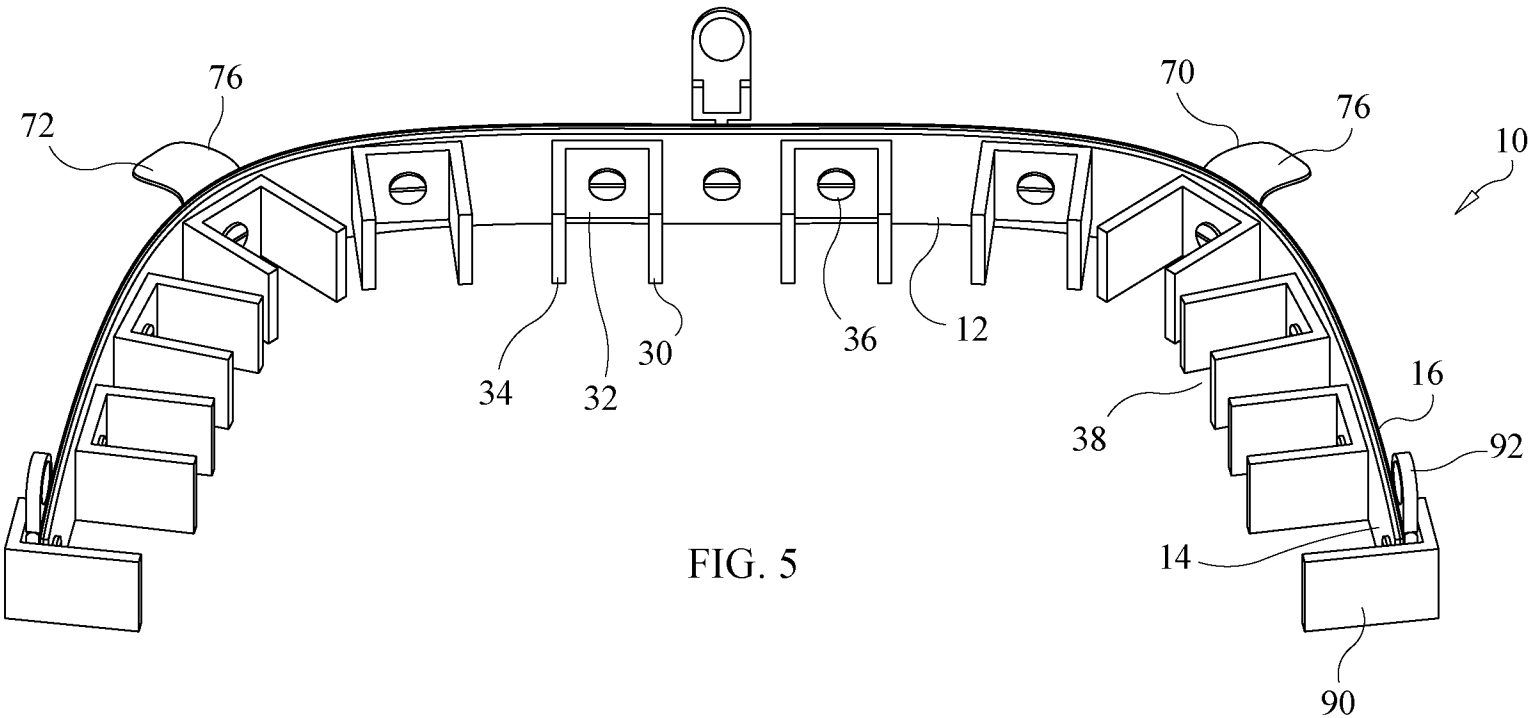
FIG. 5 is a top perspective view of a portable mountable sports stick rack in accordance with another embodiment of the invention.
Figure 6:
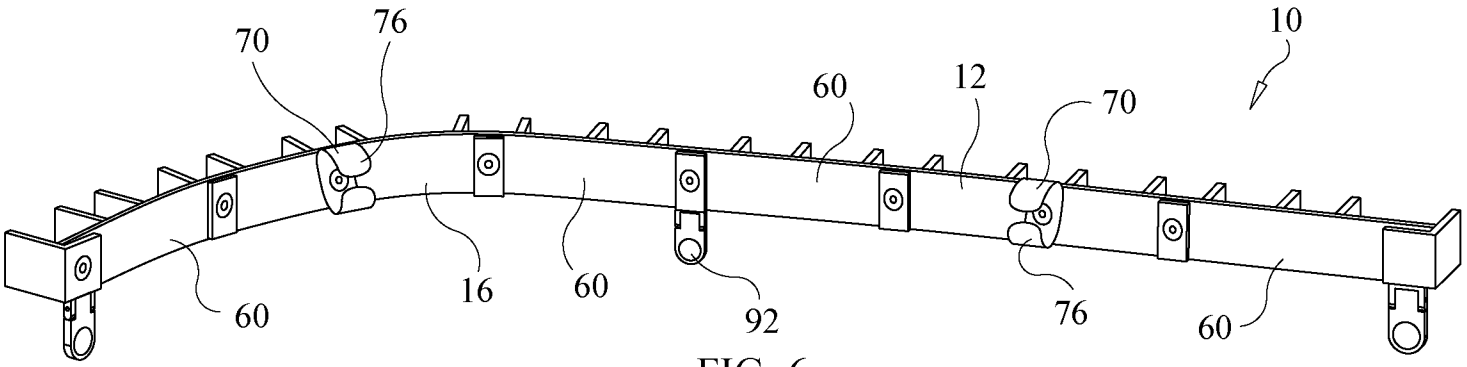
FIG. 6 is a bottom perspective of the portable mountable sports stick rack of FIG. 5 showing the cover.
Figure 7:
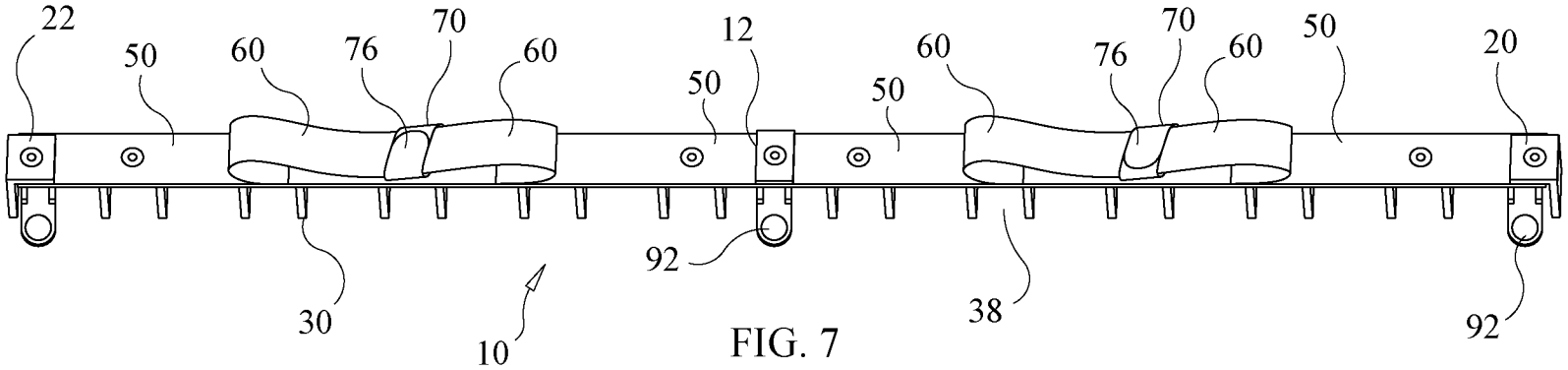
FIG. 7 is a rear perspective of the portable mountable sports stick rack of FIG. 5 showing the cover displaced and exposing the adhesive layer.
Figure 8:
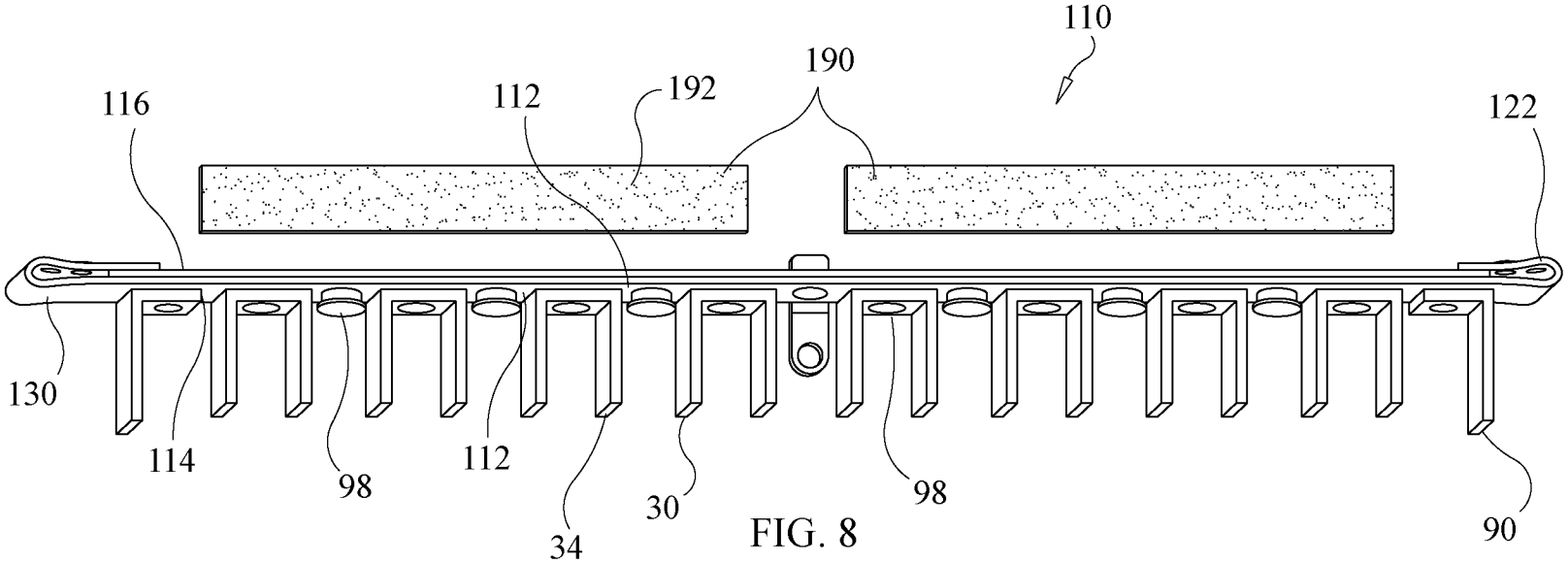
FIG. 8 is a top view of a portable mountable sports stick rack in accordance with another embodiment of the invention.

In another aspect as shown in FIGS. 5 to 7, and more clearly in FIGS. 6 and 7, the cover fastener 70 comprises one or more pairs of moveable fingers 76 adapted to come together and form a ring-like structure that reversibly secures the free end 64 of one or more the covers 60 to expose the adhesive layer 50 for mounting the rack 10 to the wall surface. In these aspects, the one or more pairs of moveable fingers 76 comprise mutually engaging structures, such as but not limited to Velcro™-type fasteners.

In another aspect as shown in FIGS. 19 to 23, the cover fastener 70 comprises an arm 78 configured to permit the user to take the free end 64 of the cover 60 and slide it between the body of the cover fastener 70 and the arm 78 and then loop it around and tuck the free end 64 adjacent to the rear side 16 of the support 12 when the rack 10 is adhered to the wall surface 2.

The plurality of sport stick retaining channels 30 are dimensioned to allow the insertion of the sport sticks and keep them separated from adjacent sport sticks. Each one sport stick retaining channel 30 can be adapted to be independently moveable in respect of an adjacent sport stick retaining channel 30 or can be connected to one or more an adjacent sport stick retaining channels 30.

Each one sport stick retaining channel 30 can be substantially u-shaped and comprise a base 32 secured to the support 12 and a pair of arms 34 attached to and projecting away from the support 12. The pair of arms 34 define a shaft receiving opening 38 dimensioned to accommodate a variety of sizes of sports sticks disposed and located therein.

In some embodiments, at least one arm of the pair of arms 34 is resiliently moveable with respect to the support 12 such that each one sport stick retaining channel 30 can receive one sport stick interferingly and hold the sports stick therebetween. In some other embodiments, the pair of arms 34 may include one or more bosses (not shown) that project into the opening 38 to help keep the sports stick located therein.

In some aspects, the sport stick retaining channels 30 are made from composite materials, rigid plastics, or similar materials that are durable. In some embodiments, the sport stick retaining channels 30 may be made with materials that have some inherent stickiness so as to frictionally retain the sports stick therein. In some embodiments, sport stick retaining channels 30 may even coated with one or more layers of silicone-like material.

The sport stick retaining channel 30 can be secured to the support 12 by any known means. As shown in the FIGS, the sport stick retaining channel 30 can be secured at the base 32 to the support 12 by using any suitable fastener 36 such as but not limited to a bolt, a screw, a rivet, and the like. In some alternative embodiments, the sport stick retaining channel 30 could be directly 3D printed onto the support 12 by direct injection of suitable material. One suitable method would be direct injection of thermoformable materials onto the support 12, using known overmoulding methods a strap, ribbon, weave, or cord, as exemplified by those used by the JTTI group (http://www.jtti.com/en/injection/) comprising injecting the thermoformable material into the injecting presses, application of heat to soften the material, and then this material is injected into a mold, and when cooled, the material keeps the shape of the mold.

Figure 15:
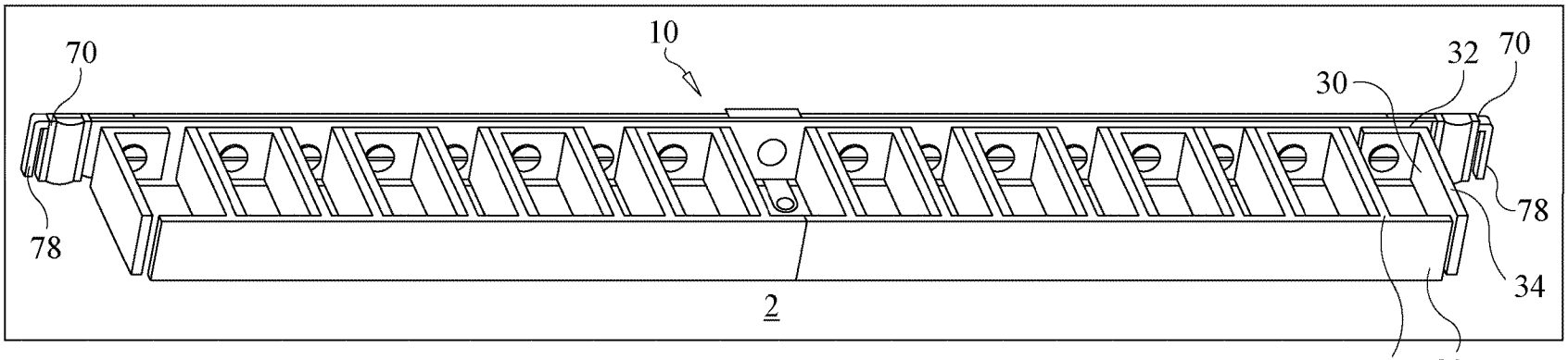
FIG. 15 shows a portable mountable sports stick rack mounted on a wall surface with a channel cover associated in the sport stick retaining channel to prevent resists withdrawal of the sports stick.
Figure 16:
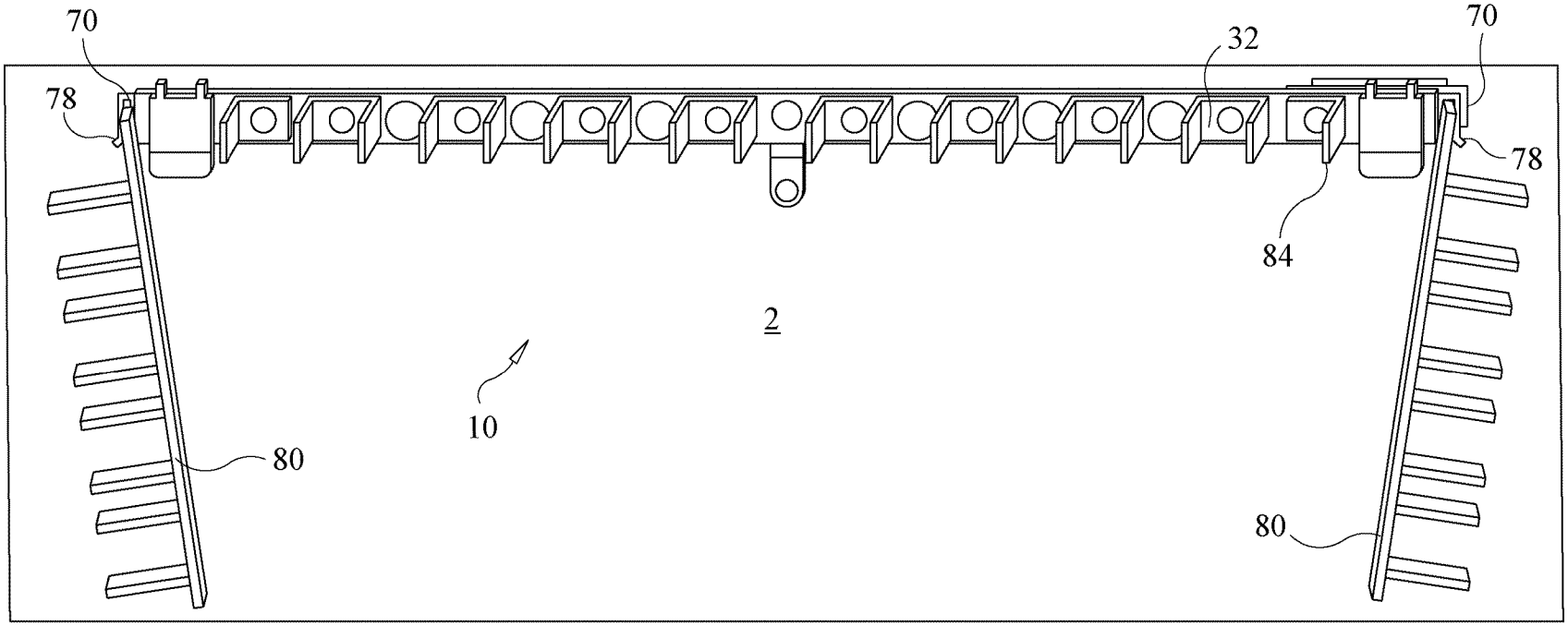
FIG. 16 shows the portable mountable sports stick rack of FIG. 15 with the channel cover displaced away the sport stick retaining channel but still attached to the rack.
Figure 18:
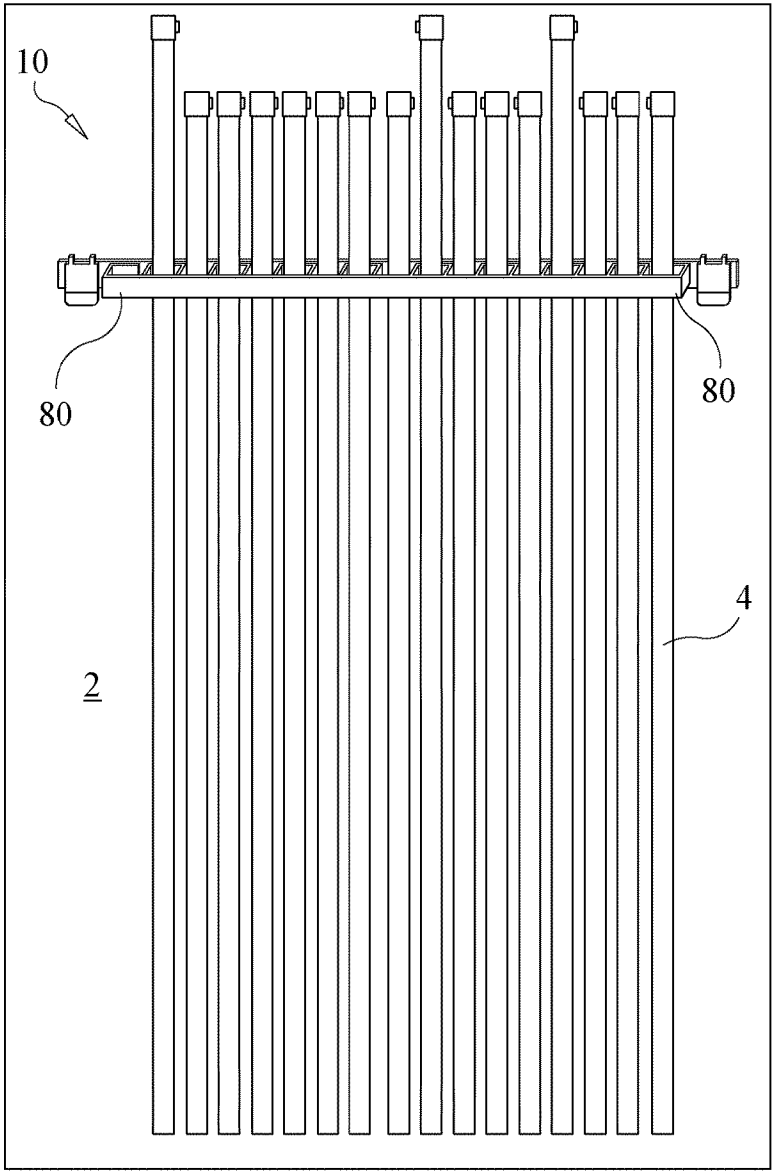
FIG. 18 shows the portable mountable sports stick rack of FIG. 15 in use with ringette sticks.
Figure 17:
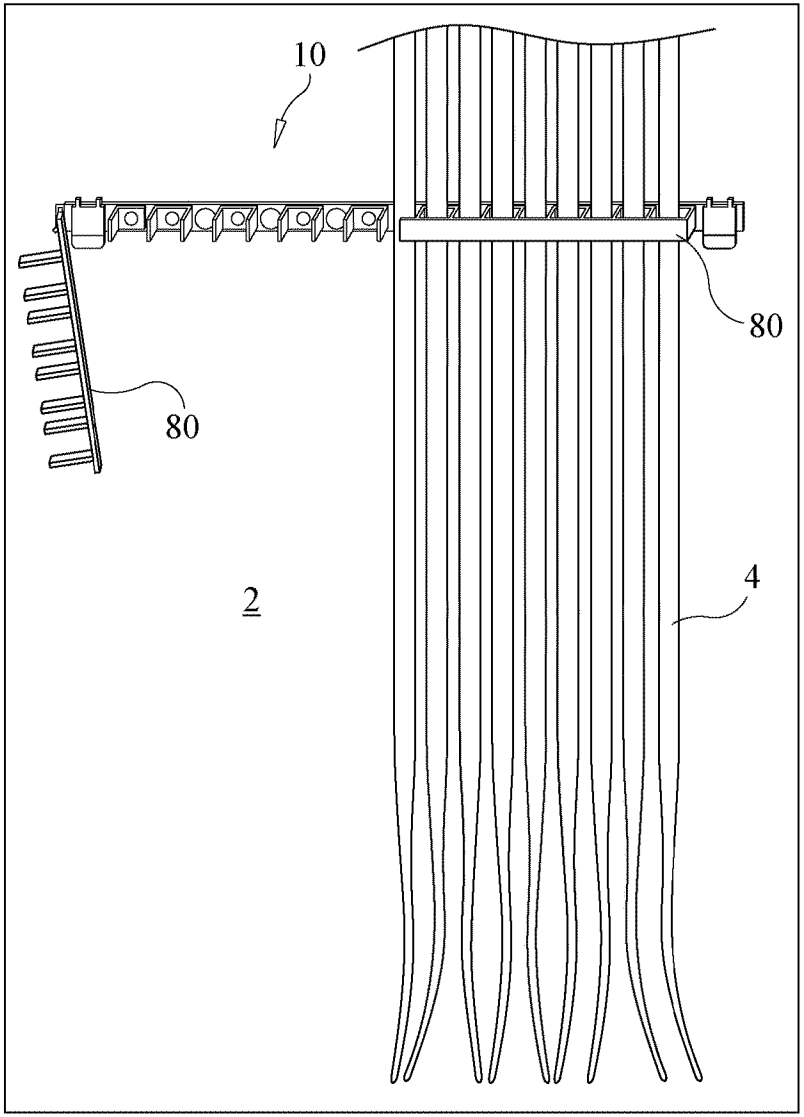
FIG. 17 shows the portable mountable sports stick rack of FIG. 15 in use with hockey sticks.

With reference to FIGS. 15 and 16, a channel cover 80 is suitably profiled so that when the channel cover 80 is brought together with the sport stick retaining channel 30 (as shown in FIG. 15), the channel cover 80 is retained by the support 12 and the channel cover 80 resists withdrawal of the sports stick out of the shaft receiving opening 38 as shown in FIG. 17 in the case of hockey sticks, and in FIG. 18 in the case of ringette sticks.

In some embodiments, at least one of the channel 30 and the cover 80 is adapted such that the channel cover 80 can be retained by the channel 30 through friction fit. In other another embodiment, securing means 82 are provided to reversibly secure the channel cover 80 to the channel 30, where for example, securing means 82 comprise mutually cooperating structures (not shown) on the channel 30 and channel cover 80 which are adapted to allow the channel 30 to retain the channel cover 80 by snap-fit. In some other embodiments, the channel cover 80 may include one more detents (show shown) for engaging the one or more bosses (not shown) on the pair of arms 34 that project into the opening 38 to help retain the channel cover 80 to the sport stick retaining channel 30 and thus to the rack 10. When not in use, one end of the channel cover 80 may be clipped to and be retained by the cover fastener 70 as shown in FIG. 16.

As shown in FIGS. 1, 2, 5, and 8 to 23, rack 10 further comprises a lever 90 adapted for the user to grasp and to apply a pulling force sufficient overcome the force of adhesion of the adhesive layer 50 to the wall surface so as to peel the mounted rack 10 away from the wall surface. The lever 90 can be substantially L-shaped to facilitate grasping by the user's fingers therebetween and is located at one or at both ends 20, 22 of the support 12.

As shown throughout the FIGS., the rack 10 can further comprise one or more mounting clips 92 secured to the support 12. In some aspects, the mounting clips 92 are adapted for reversibly clipping any items to the rack 10, including training regimens and/or player lists or flags and banners, for example.

Figure 20:
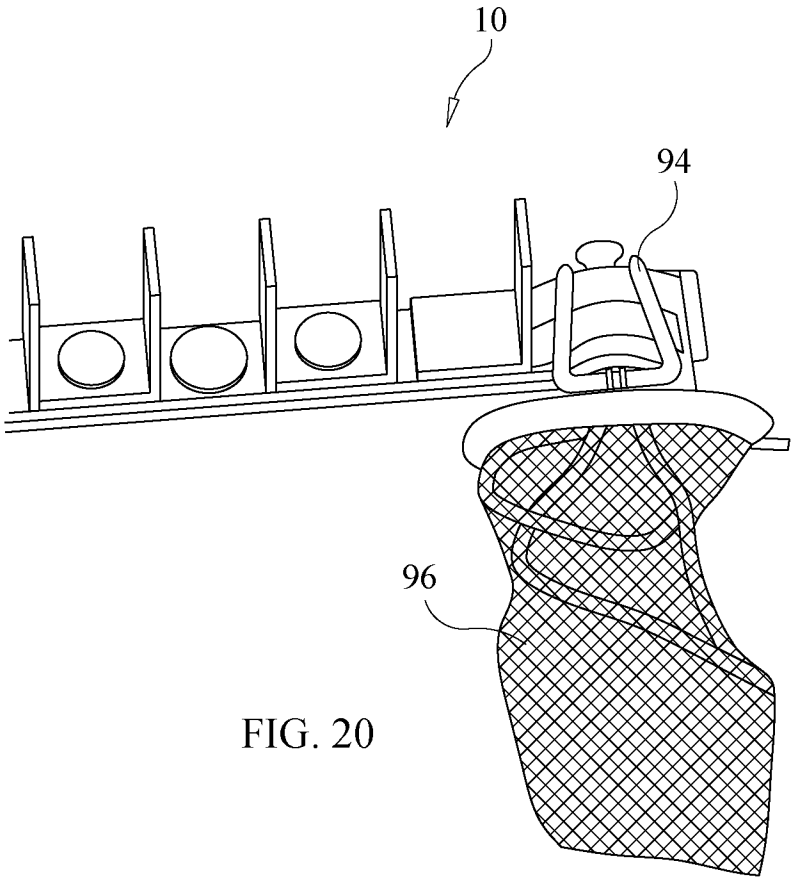
FIG. 20 is an enlarged view of one end of the portable mountable sports rack of FIG. 19 with a first accessory mount according to an embodiment of the invention.
Figure 19:
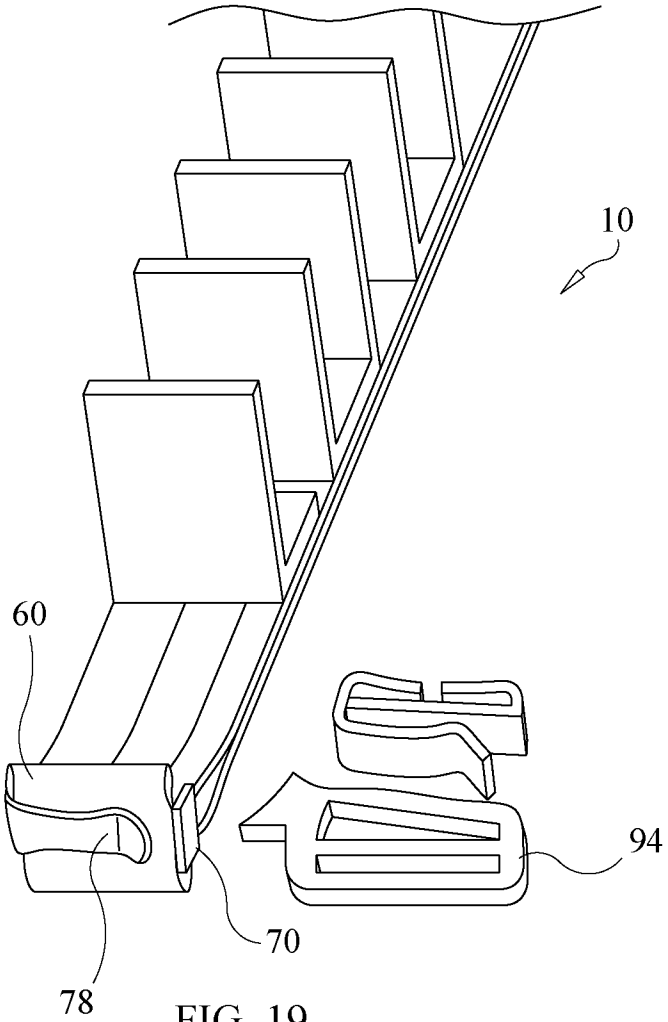
FIG. 19 is an enlarged view of one end of the portable mountable sports rack with a cover according to another embodiment of the invention.
Figure 21:
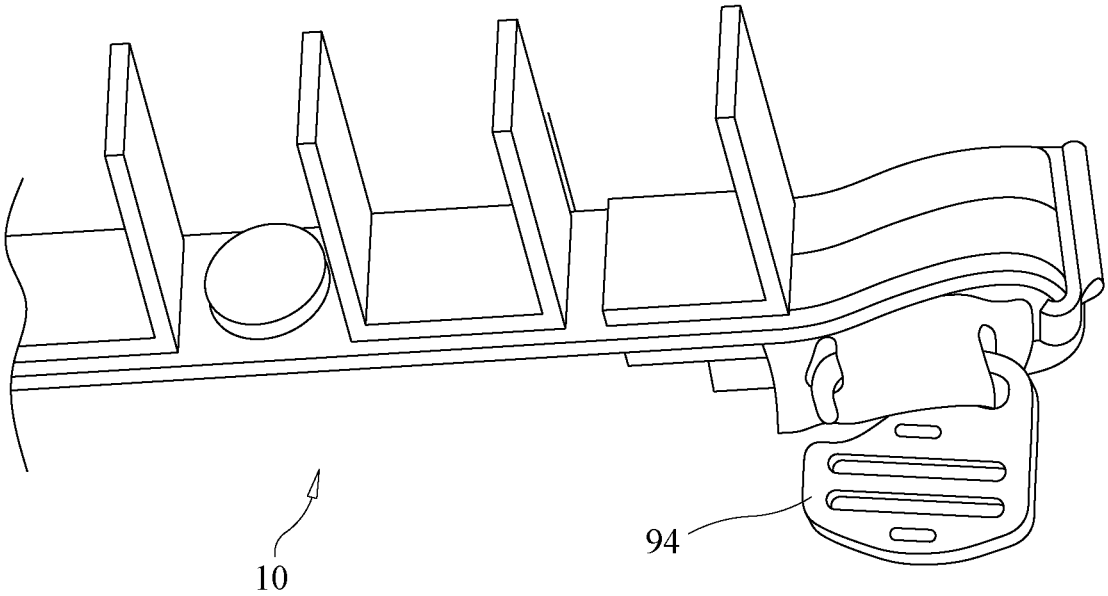
FIG. 21 is an enlarged view of one end of the portable mountable sports rack of FIG. 19 with a second accessory mount according to another embodiment of the invention.
Figure 22:
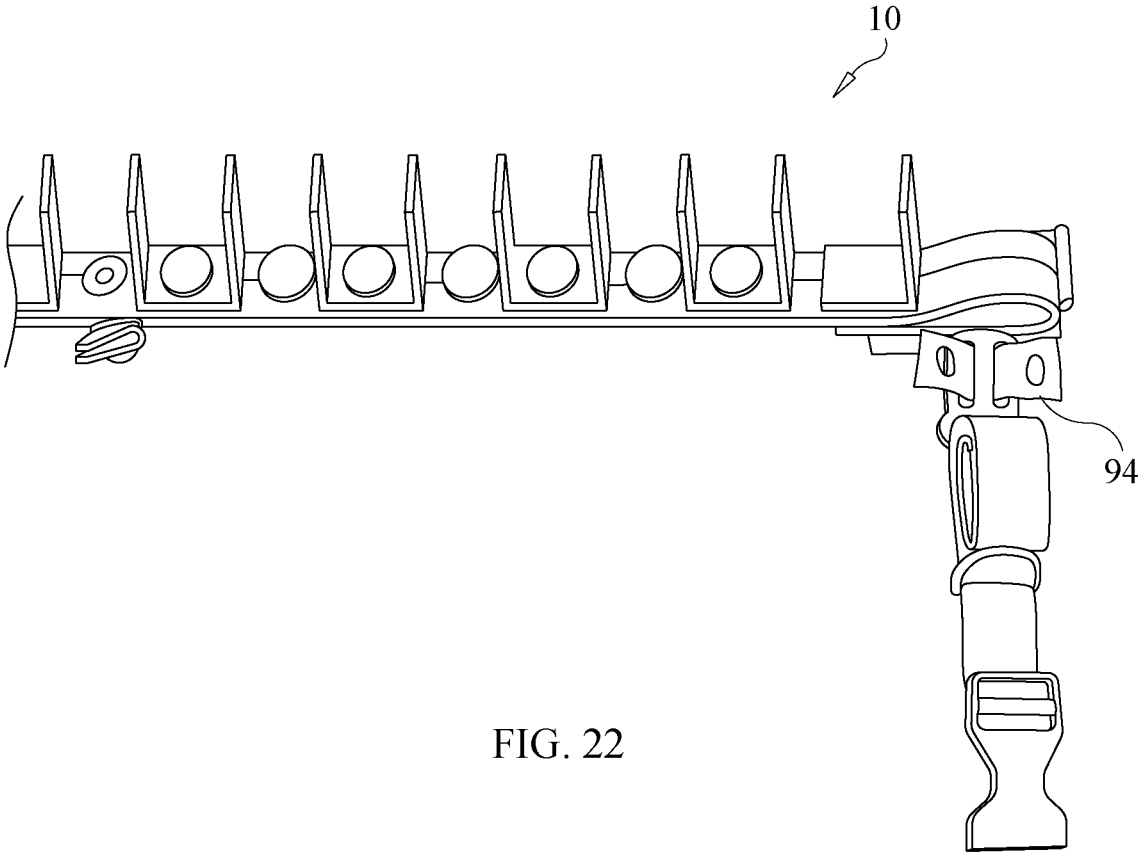
FIG. 22 is an enlarged view of one end of the portable mountable sports rack with a third accessory mount according to yet another embodiment of the invention.
Figure 23:
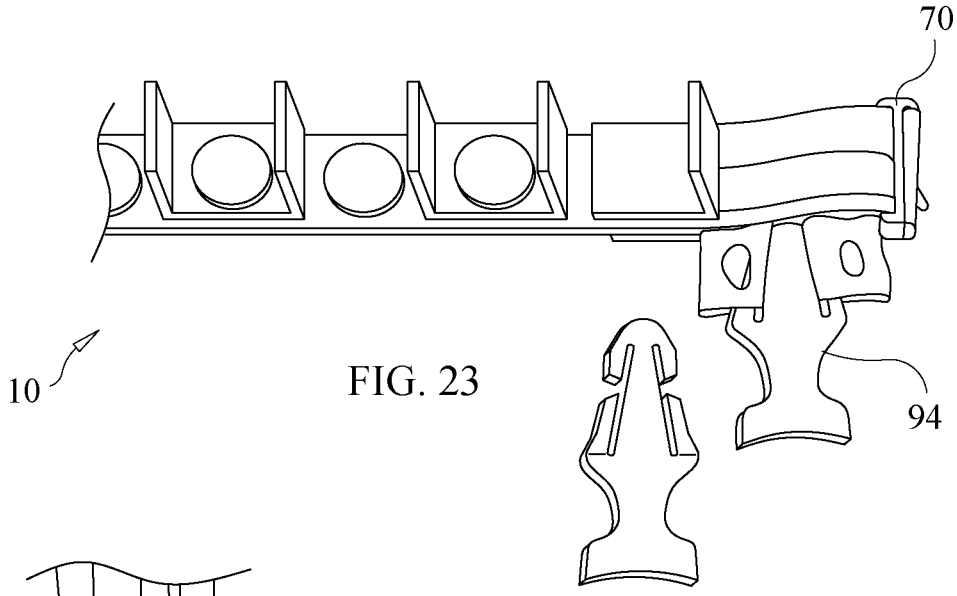
FIG. 23 is an enlarged view of one end of the portable mountable sports rack with a fourth accessory mount according to yet another embodiment of the invention.

As shown in FIGS. 19 and 20, the rack 10 can further comprise one or more accessory mounts 94 secured to the support 12. In some aspects, each of the accessory mounts 94 are located at the ends 20, 22 and are adapted for reversibly attaching accessories 96 to the rack 10. Suitable accessory mounts 94 can come in a variety of forms including for example, Molle™ webbing clips and various accessories 96 can include, but not limited to, mesh baskets 96 for holding small tools or the channel cover 80 (as shown in FIG. 16) or sanitary masks (not shown). In aspects as shown in FIGS. 21, 22, and 23, accessory mounts 94 may also be sewn into one or more of the ends 20 and 22 of the support 12 and be adapted to conveniently and quickly mount accessories 96 using straps (FIG. 21), two-piece clips (FIG. 22), or buckles (FIG. 23).

Referring now to FIGS. 8 to 12 which show a second embodiment 110 of the sports stick rack which generally comprises a support 112 having: front side 114 and an opposed rear side 116; first end 120 and second end 122, wherein the first end and the second end define length 124 therebetween; wherein the rear side 116 is adapted for placement upon a wall surface 2; wherein the front side 114 comprises at least one sports stick retaining channel 30 for receiving a sports stick (not shown) therethrough; and wherein the channel 30 is adapted to releasably secure the sports stick in an upright vertical position when the portable mountable sports stick rack 110 is secured to the wall surface.

Figure 9:
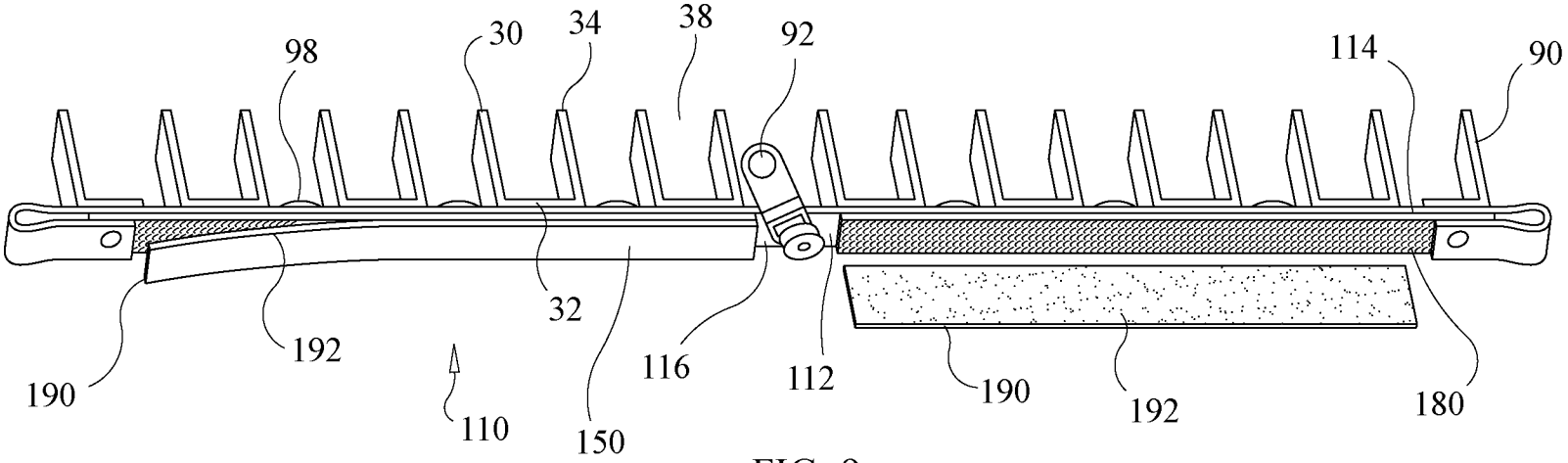
FIG. 9 is a rear perspective of the portable mountable sports stick rack of FIG. 8 in accordance with an embodiment of the invention.

As shown in FIG. 9, an adhesive layer 150 is adapted to be reversibly associated with rear side 116 of support 112. In these embodiments, the support 112 comprises first cooperatively engaging fasteners 180 associated with the rear side 116. The rack 110 further comprises an adhesive portion 190 which comprises, on one side, second cooperatively engaging fasteners 192 which are adapted to reversibly couple to the first cooperatively engaging fasteners 180, and on another side, the adhesive layer 150 for mounting the rack 110 to the wall surface.

The embodiment according to FIGS. 8 to 12 may find use, for example, at sport venue locations which have designated spaces reserved for storing sports sticks and it is desired to allow one or more users to bring and mount their own support 112 while they visit the sports venue. In this respect, a venue operator may obtain one or more adhesive portions 190 and secure the adhesive portion 190 to the wall by turning the adhesive layer 150 towards to wall surface and generally permanently or semi-permanently secures the adhesive portion 190 to the wall surface at the sports venue. By doing so, this exposes the second cooperatively engaging fasteners 192 of the adhesive portion 190. The adhesive portion 190 may be adapted to withstand many different environmental conditions such as extreme temperatures and/or rain and snow etc . . . and as such will be suitable for indoor or outdoor use.

When a user desires to mount their own support 112 at the venue, this user brings turns the rear side 116, which includes the first cooperatively engaging fasteners 180, towards the wall surface and aligns it with the second cooperatively engaging fasteners 192 and then presses the support 112 to the adhesive portion 190 to temporarily mount the support 112 to the wall surface. When this same user desires to leave the sports venue, the user pulls on the support 112 to disassociate it from the adhesive portion 190 which remains adhered to the wall surface and available for use by another user. At home, the same user could mount the support 112 to another adhesive portion 190 that may be more permanently secured to the wall surface at this user's home.

In some aspects, the first cooperatively engaging fasteners 180 and the second cooperatively engaging fasteners 192 are hook and loop fasteners. In some preferred aspects, the hook and loop fasteners are Velcro™-type material such as for example, 3M Dual Lock™ reclosable fasteners. In some aspects, as shown in FIGS. 8, 9, 11, and 12, the adhesive portion 190 may comprise translucent material so that various information such as the individual's name, a team name, and/or team logos can be displayed on the wall surface prior to the mounting of the support 112 by the user.

Figure 10:
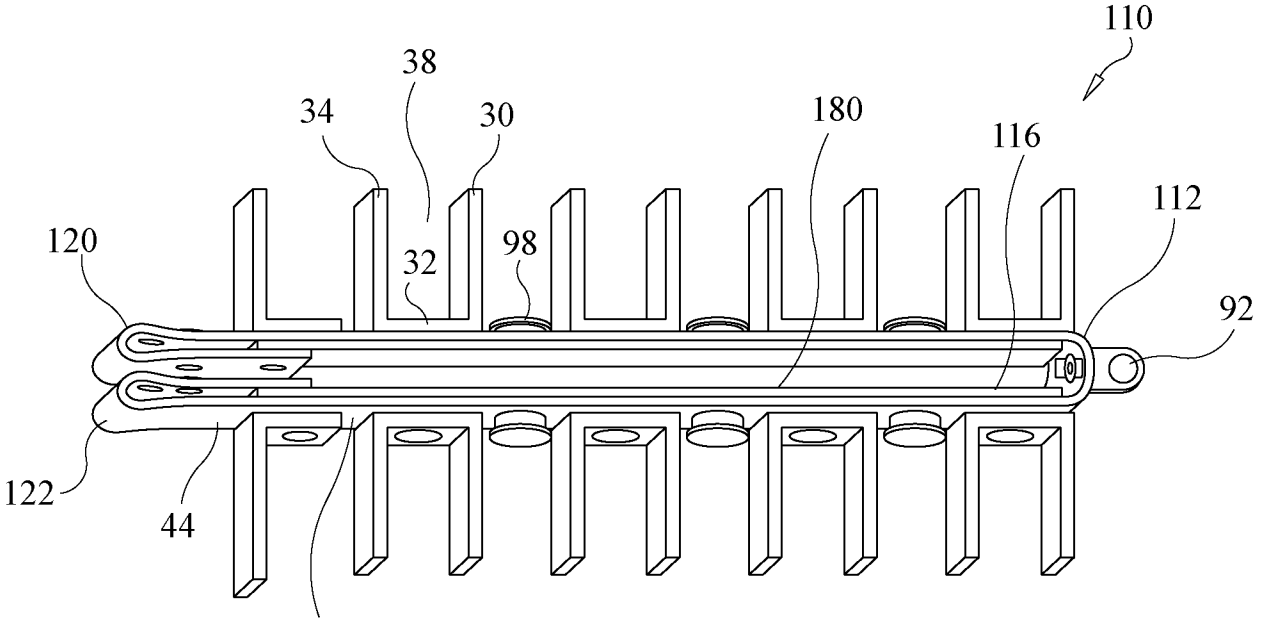
FIG. 10 is a top view of the portable mountable sports stick rack of FIG. 8 showing sufficient compliance such that the ends are adapted to contact each other via manipulation by a user into a compact position and be held in the compact position.
Figure 11:
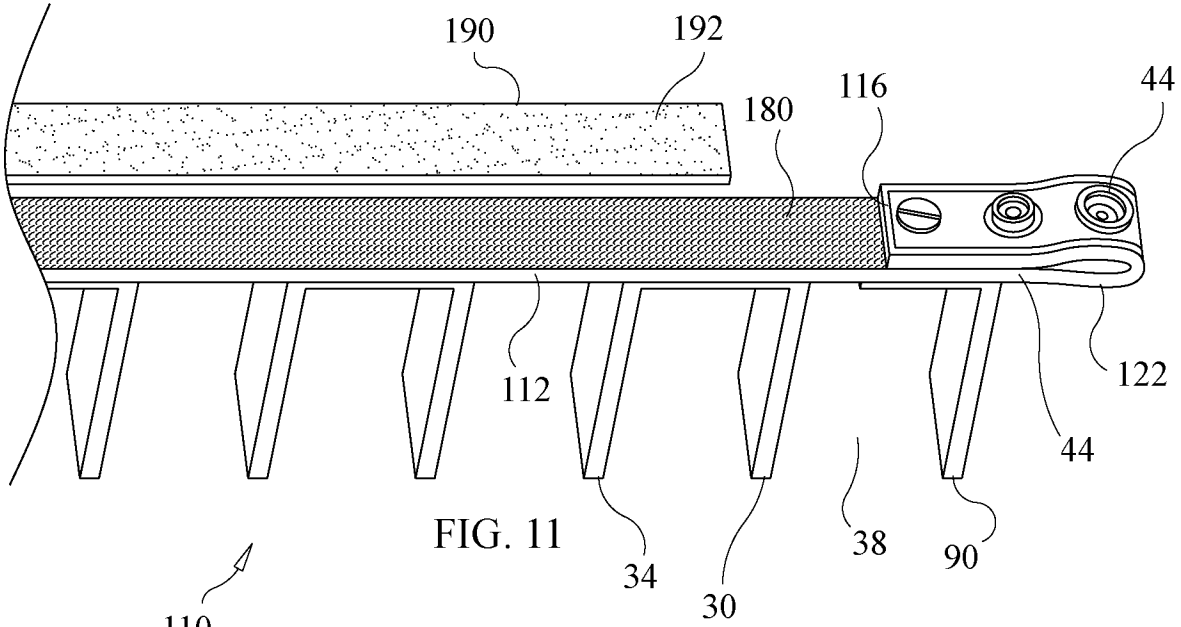
FIG. 11 is an enlarged view of the portable mountable sports stick rack of FIG. 8 showing an end.

As shown in FIGS. 8 to 12, the closures 40 can also comprise cooperatively engaging snap tabs 44 at the opposed ends 20, 22 of the support 112 which connect to each other to lock the rack 110 in the compact position as shown in FIG. 10. In some embodiments, the snap tabs 44 may also find an additional purpose in securing the support 112 to the wall surface. In this regard, one or more snap tabs 44 are secured to the support 112 near or at any point between the opposed ends 20, 22 and corresponding mutually engaging snap tabs are either removably secured to the wall surface using adhesive (e.g. Adhesive backed flexible base sockets available at https://www.sailrite.com/YKK-SNAD-Clear-25mm-Adhesive-Backed-Flexible-Base-Socket) or are more permanently secured to the wall surface using wall studs. In use, the user would line up the snap tabs 44 with the corresponding mutually engaging snap tabs on the wall and apply a force to lock the tabs into place to secure the support 112 to the wall surface.

As shown in FIGS. 10 and 12, various team logos or any other indicia can be displayed anywhere there is space on the rack 10 or 110 or channel cover 80. In some embodiments, as shown in FIGS. 8, 10, 12, and 15 to 23, the exposed portions of the fastener 36 may be concealed from view by a cap 98 which itself can be adorned with any desired information or design such as a logo.

Figure 24:
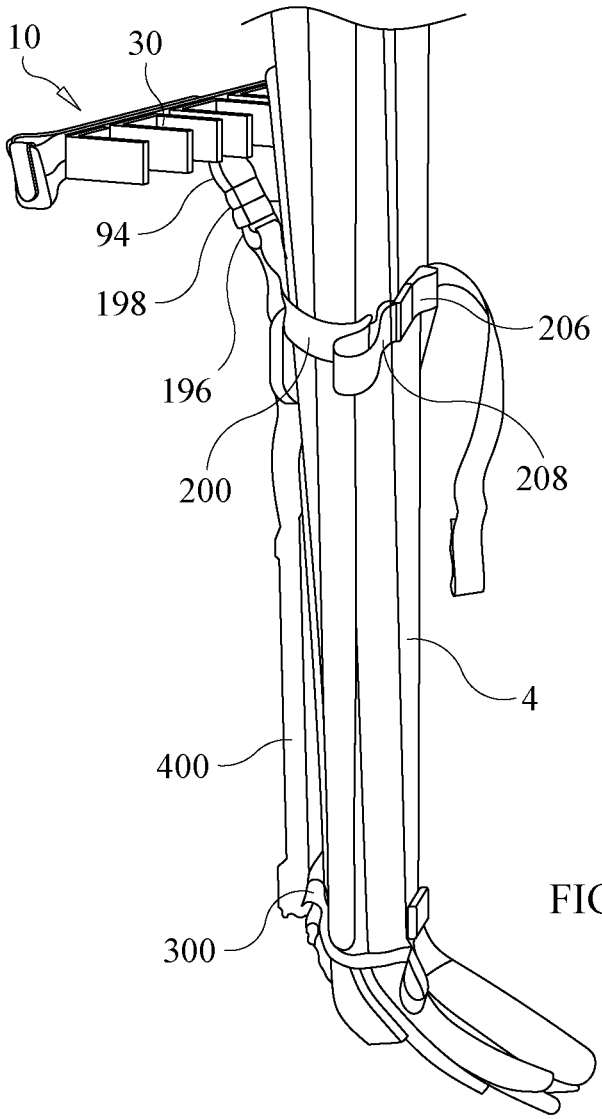
FIG. 24 is a perspective view of a portable mountable sports rack with an attached sport stick harness for strapping together a plurality a sports sticks.

As shown in FIGS. 24 to 27, the rack 10 is adapted to mount any desired accessory 96 via the accessory mount 94. As shown in FIG. 24, one accessory mount 94 can be secured in the middle between the ends of the rack 10 and configured to reversibly mount a sport stick harness 196 via a lockable buckle 198. The harness 196 is thus secured to the compliant support 12 and is adapted to reversibly retain and encircle one or more sports sticks 4 when the one or more sports sticks 4 are emplaced on the sport stick rack 10. In this manner, harness 196 prevent sports sticks 4 from being unintentionally dislodged when each one sport stick 4 is disposed within the channel 30 or even discourage casual theft by increasing the effort required the displace the sport stick 4 from within the channel 30 and/or drawing attention to a theft in progress.

Figure 25:
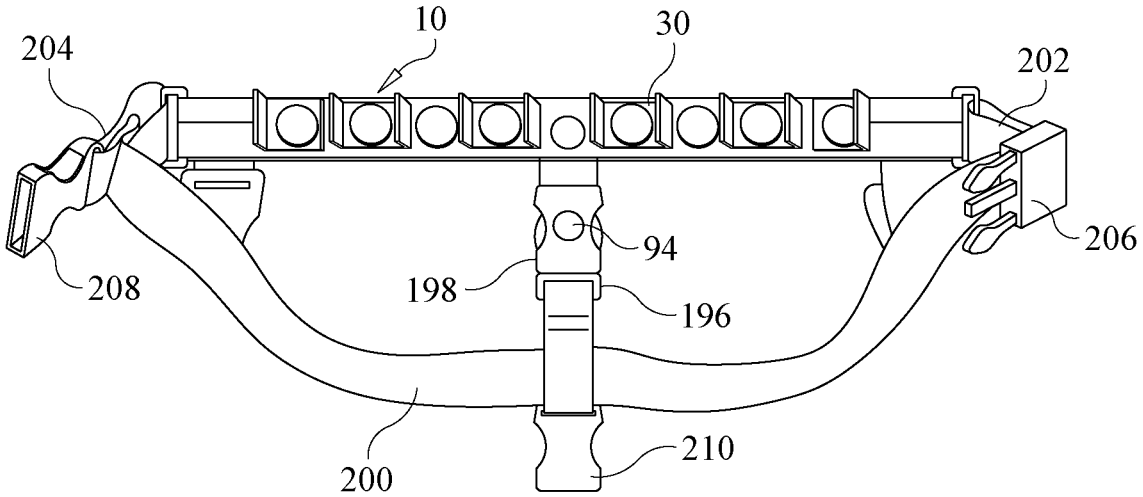
FIG. 25 is a front view of the sport stick harness of FIG. 24 shown with an open loop and in isolation from a plurality a sports sticks.
Figure 26:
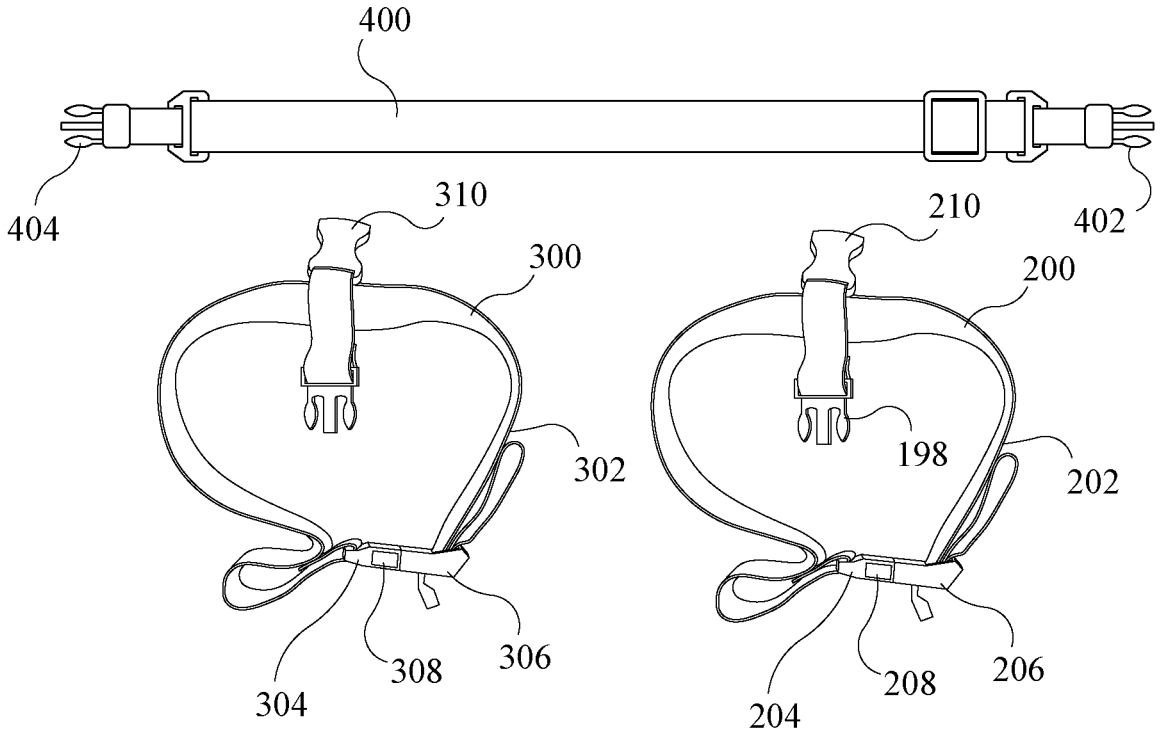
FIG. 26 is a front view of the sport stick harness including a first strap and a second strap for strapping together a plurality a sports sticks.

As shown in FIGS. 24 to 26, the harness 196 comprises a first strap 200 having a first end 202 couplable to a second end 204 to form an adjustable closed loop which can be tightened around a portion of the one or more sports sticks 4, such as a top portion of a hockey stick. As shown in FIG. 24, harness 196 is adapted to be caused by a user to tightenly secure the one or more sports sticks 4 encircled therein similar to a lasso-like action when the one or more sports sticks 4 are displaced from within the channel 30 of the sport stick rack 10. When the one or more sports sticks 4 are lassoed together this will enable the user to use the harness 196—when it is separated from the rack 10—as a modular carrying system to move the one or more sports sticks 4 from one location to another.

As shown in FIGS. 24 and 26, harness 196 can also comprise a second strap 300 having a first end 302 couplable to a second end 304 to form an adjustable closed loop around a lower portion of the one or more sports sticks 4, such as the blade of a hockey stick.

The first end 202 and 302 and the second end 204 and 304 comprise mutually cooperating male locking buckles 206, 306 and female locking buckles 208, 308 to reversibly lock the first end 202 and 302 to the second end 204 and 304, respectively. In one aspect, the male 206, 306 and female 208, 308 locking buckles are adapted so that the first strap 200 and the second strap 300 can be tightened by a right handed pulling action on one end or by a left handed pulling action on the same end.

Figure 27:
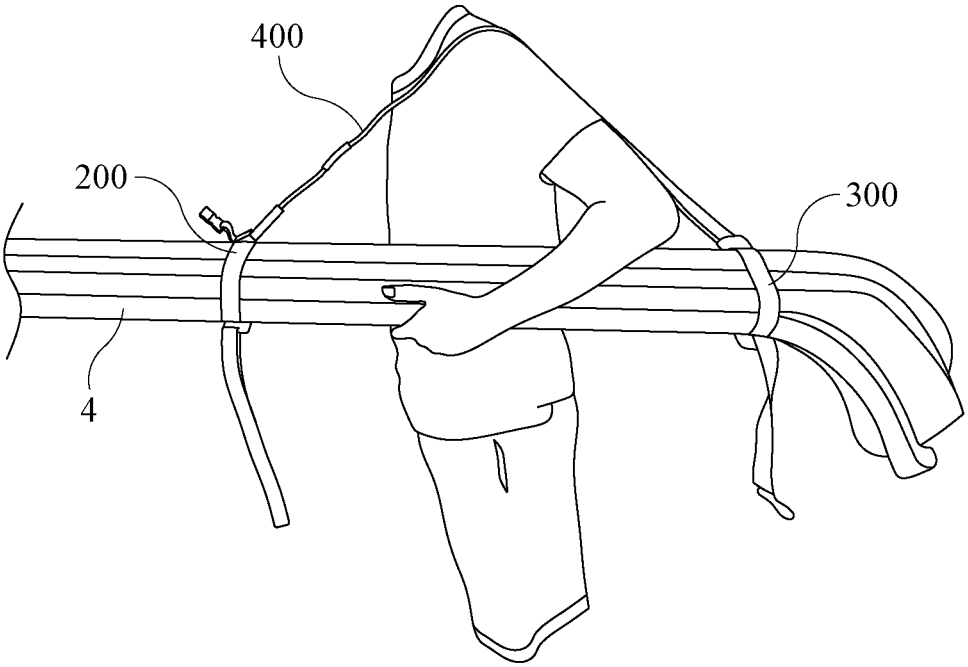
FIG. 27 is a side view of the sport stick harness including a connecting strap configured to carry the plurality a sports sticks over the shoulder of a user.

As shown in FIGS. 24 and 27, the harness 196 can further comprise an elongate connecting strap 400 connecting the first strap 200 to the second strap 300. Since the harness 196 can be removably secured to the rack 10, when the connecting strap 400 is used, it balances the ends of the plurality of sports sticks 4 and can serve as a shoulder strap to enable a plurality of sports sticks 4 tightenly secured by the harness 196 to be carried over the shoulder of the user to move the plurality of sports sticks 4 from one location to another location. In aspects, the elongate connecting strap 400 includes end buckle 402 and end buckle 404 for reversibly securing to the first strap 200 by mutually cooperating buckles 210 and the second strap 300 by mutually cooperating buckles 310.

It will be appreciated that the present invention includes kits for a portable wall-mountable sports stick rack. A kit may comprise a compliant support having a front side and an opposed rear side; a plurality of sports stick retaining members secured to the front side; and an adhesive portion secured to the rear side, the adhesive portion comprising an adhesive layer and configured to expose the adhesive surface for removeably securing the sports stick rack to a wall surface. In some aspects, adhesive portion is reversibly associated with the compliant support. In additional aspects, the compliant support comprises first cooperatively engaging fasteners secured to the rear side and the adhesive portion comprising, on one side, second cooperatively engaging fasteners adapted to reversibly couple to the first cooperatively engaging fasteners, and on another side, the adhesive layer.

The embodiments of the present application described above are intended to be examples only. Those of skill in the art may effect alterations, modifications and variations to the particular embodiments without departing from the intended scope of the present application. In particular, features from one or more of the above-described embodiments may be selected to create alternate embodiments comprised of a subcombination of features which may not be explicitly described above. In addition, features from one or more of the above-described embodiments may be selected and combined to create alternate embodiments comprised of a combination of features which may not be explicitly described above. Features suitable for such combinations and subcombinations would be readily apparent to persons skilled in the art upon review of the present application as a whole. Any dimensions provided in the drawings are provided for illustrative purposes only and are not intended to be limiting on the scope of the invention. The subject matter described herein and in the recited claims intends to cover and embrace all suitable changes in technology.

The invention claimed is:

1. A portable wall-mountable sports stick rack comprising:

a continuously compliant strap having a first end, a second end opposed to the first end, wherein said continuously compliant strap is compliant along a length from the first end to the second end, a front side, and a rear side opposed to the front side;

a plurality of sports stick retaining channels mounted to the continuously compliant strap along the length on the front side, wherein each one channel of said plurality of sports stick retaining channels is adapted to receive a sports stick therethrough in an upright position perpendicular to the length of the continuously compliant strap from the first end to the second end; and an adhesive layer associated with the rear side, the adhesive layer configured to removeably mount the sports stick rack to a wall surface, wherein said continuously compliant strap is foldable along the length such that the continuously compliant strap is configured to move between a furled compact position when the first end is brought into close proximity to the second end and where the plurality of sports stick retaining channels along the length are folded into an overlapping relationship for carrying by a user when the rack is unmounted from the wall surface to an unfurled position when the first end is no longer in close proximity to the second end and the plurality of sports stick retaining channels along the length are no longer folded into the overlapping relationship for mounting the rack to the wall surface.

2. The rack of claim 1 further comprising a cover configured to reversibly move between a covered position wherein the adhesive layer is covered by the cover to an exposed position wherein the adhesive layer is exposed for attaching the sports stick rack to the wall surface.

3. The rack of claim 2 wherein the cover comprises a fixed end secured to the strap and a free end.

4. The rack of claim 3 further comprising a cover fastener secured to the strap for releasably securing the free end of the cover when the cover is moved to the exposed position.

5. The rack of claim 4 wherein the cover is a film or tape.

6. The rack of claim 1 wherein the adhesive layer is reversibly associated with the rear side.

7. The rack of claim 6 further comprising first cooperatively engaging fasteners secured to the rear side and an adhesive portion comprising, on one side, second cooperatively engaging fasteners adapted to reversibly couple to the first cooperatively engaging fasteners, and on another side, the adhesive layer.

8. The rack of claim 7 wherein the first and second cooperatively engaging fasteners are hook and loop fasteners.

9. The rack of claim 1 wherein the continuously compliant strap comprises nylon.

10. The rack of claim 1 further comprising closures for releasably maintaining the rack in the furled compact position.

11. The rack of claim 1 wherein the plurality of sports stick retaining channels comprise a pair of arms projecting from the strap.

12. The rack of claim 11 wherein the pair of arms being able to flex with respect to the strap to receive the sport stick interferingly therebetween.

13. The rack of claim 11 wherein each one of the plurality of sports stick retaining channels is independently moveable in respect to one or more adjacent sports stick retaining channels.

14. The rack of claim 11 further comprising a channel cover and means to reversibly secure the channel cover to the plurality of sports stick retaining channels, wherein when the plurality of sports stick retaining channels is secured to the channel cover, the channel cover resists withdrawal of the sports stick out of the plurality of sports stick retaining channels.

15. The rack of claim 1, further comprising a sport stick harness secured to the continuously compliant strap, wherein the harness is adapted to encircle one or more sports sticks therein when the one or more sports sticks are emplaced on the sport stick rack.

16. The rack of claim 15 wherein the harness comprises a first strap having a first end couplable to a second end to form an adjustable closed loop to tighten around a portion of the one or more sports sticks.

17. The rack of claim 16 wherein the harness comprises a second strap having a first end couplable to a second end to form an adjustable closed loop around a lower portion of the one or more sports sticks.

18. A kit for a portable wall-mountable sports stick rack, the kit comprising:

a continuously compliant strap having a first end, a second end opposed to the first end, wherein said continuously compliant strap is compliant along a length from the first end to the second end, a front side, and a rear side opposed to the front side;

a plurality of sports stick retaining members mounted to the continuously compliant strap along the length on the front side, wherein each one channel of said plurality of sports stick retaining channels is adapted to receive a sports stick therethrough in an upright position perpendicular to the length of the continuously compliant strap from the first end to the second end; and an adhesive portion securable to the rear side, the adhesive portion comprising an adhesive layer and configured to expose the adhesive layer for removeably securing the sports stick rack to a wall surface, wherein said continuously compliant strap is foldable along the length such that the continuously compliant strap is configured to move between a furled compact position when the first end is brought into close proximity to the second end and where the plurality of sports stick retaining channels along the length are folded into an overlapping relationship for carrying by a user when the rack is unmounted from the wall surface to an unfurled position when the first end is no longer in close proximity to the second end and the plurality of sports stick retaining channels along the length are no longer folded into the overlapping relationship for mounting the rack to the wall surface.

19. The kit of claim 18 wherein the adhesive portion is reversibly associated with the continuously compliant strap.

20. The kit of claim 19 wherein the continuously compliant strap comprises first cooperatively engaging fasteners secured to the rear side and the adhesive portion comprising, on one side, second cooperatively engaging fasteners adapted to reversibly couple to the first cooperatively engaging fasteners, and on another side, the adhesive layer.

* * * * *